United States Patent [19]

Wang

[11] Patent Number: 4,909,651

[45] Date of Patent: Mar. 20, 1990

[54] PORTABLE FILE FOR FORM FEEDS PAPER

[76] Inventor: B. Y. Wang, 3/F No. 740, Chung Chen Road, Yung-Ho Taipei Hsien, Taiwan

[21] Appl. No.: 318,320

[22] Filed: Mar. 3, 1989

[51] Int. Cl.[4] ..... B42F 3/00; B42F 9/00; B42F 13/02

[52] U.S. Cl. ..... 402/4; 402/9

[58] Field of Search ..... 402/4, 9, 80 R, 80 P

[56] References Cited

U.S. PATENT DOCUMENTS

| | | | |
|---|---|---|---|
| 2,641,261 | 6/1953 | Vthrriague | 402/9 |
| 4,487,520 | 12/1984 | Maier-Hunke et al. | 402/4 X |
| 4,685,821 | 8/1987 | Marsh | 402/4 |

*Primary Examiner*—Paul A. Bell

*Attorney, Agent, or Firm*—Lowe, Price, LeBlanc, Becker & Shur

[57] ABSTRACT

This invention relates to a portable file for form feeds paper, which is comprised of an upper and a lower cover board, each having an integrally made channel bar for setting therein of flexible cords at both ends to let the flexible cords insert through the perforations of form feeds paper document. By means of retainer means to slide in the channel bars, the flexible cords may be pulled out for insertion into the perforations of form feeds paper or may be retained by the retainer means in the channel bars respectively. A hanger is provided and attached to the lower cover board by means of rivets, such that the file may be hanging on a storage stand with form feeds paper document carried by the file.

2 Claims, 3 Drawing Sheets

PORTABLE FILE FOR FORM FEEDS PAPER

BACKGROUND OF THE INVENTION

Computerization is the way to go for better management. It is undoubted that computerization will be widely performed in all industries while 21st century comes. Because computer has a capability for accurate operation in high speed, it has been widely used in the industrial and business circles, and it is also favorably invited by the young students. More particularly, computer has ever been elected as one of the most heroic figures in the world. Nowdays, Factory Automation (FA), Office Automation (OA), and Home Automation (HA) are widely promoted by the governments as well as the people concerned in the developing countries. Through mass media, new information and technology are continuously introduced to the people. It is indisputable that computer will play a decisive role in the coming "time of information", and the influence of computer to our life will become more stronger each day. Computer does not only help to change people's every day life at home, but also to improve the structure of the industrial and business circles, so as to further let a country be capable of encountering new challenge of improving the material standards of living of the people. Because computer has such a magic power, people love it and are afraid of it at the same time. Because computer helps people to accurately get an answer within a very short of time, it is invited by the people. However through the application of information processing systems and the relative equipments and tools, the filing of form feeds paper data report becomes another problem to the file clerks. By means of conventional process and equipments, the filing of form feeds data report may be not well achieved. For example, when a file clerk wishes to pick up a form feeds data report file from a file storage or to put the file in place, due to the limitation of the size of fingers, one may have to use one hand to hold or support the file and to use the other hand to pull the file from the file storage or put the file into the file storage. During the operation, the form feeds paper is easy to drop and to spread over the ground owing to neglect, and the file clerk shall have to recollect the paper again. Further, regular file storages or shelves that are commonly used by the filing section of regular business firms are not designed to sustain heavy form feeds paper documents or files. The suspension of heavy files from storage frame may deform the frame to further cause the hanging files to collapse.

In view of said problems, a portable file for form feeds paper according to the present invention is created to provide better performance, which portable file includes channel bars for setting therein of flexible cords. The flexible cords are arranged to insert into the perforations of form feeds paper document. There are provided retainer means to set in the channel bars respectively at both ends to retain the flexible cords so as to let form feeds paper document be held in the file. By means of rivet connection, a hanger is attached to the lower cover board of the file so as to let the file be hung on a storage frame stand by means of the hanger.

SUMMARY OF THE INVENTION

This invention is to provide a portable file for form feeds paper, which is comprised of an upper cover board, a lower cover board, flexible cords, a hanger, several retainer means, and several rivets. The said upper and lower cover boards, each comprises an integrally made channel bar for setting therein of flexible cords at both ends to let the flexible cords insert through the perforations of form feeds paper document. By means of retainer means to slide in the channel bars, the flexible cords may be pulled out for insertion into the perforations of form feeds paper or may be retained by the retainer means in the channel bars respectively. A hanger is provided and attached to the lower cover board by means of rivets, which hanger comprises a central slot for holding of the file with hand, and also comprises two circular notches at both ends for hanging of the file on a storage frame stand.

DETAILED DESCRIPTION OF THE PREFERRED EMBODIMENTS

Figure 1:
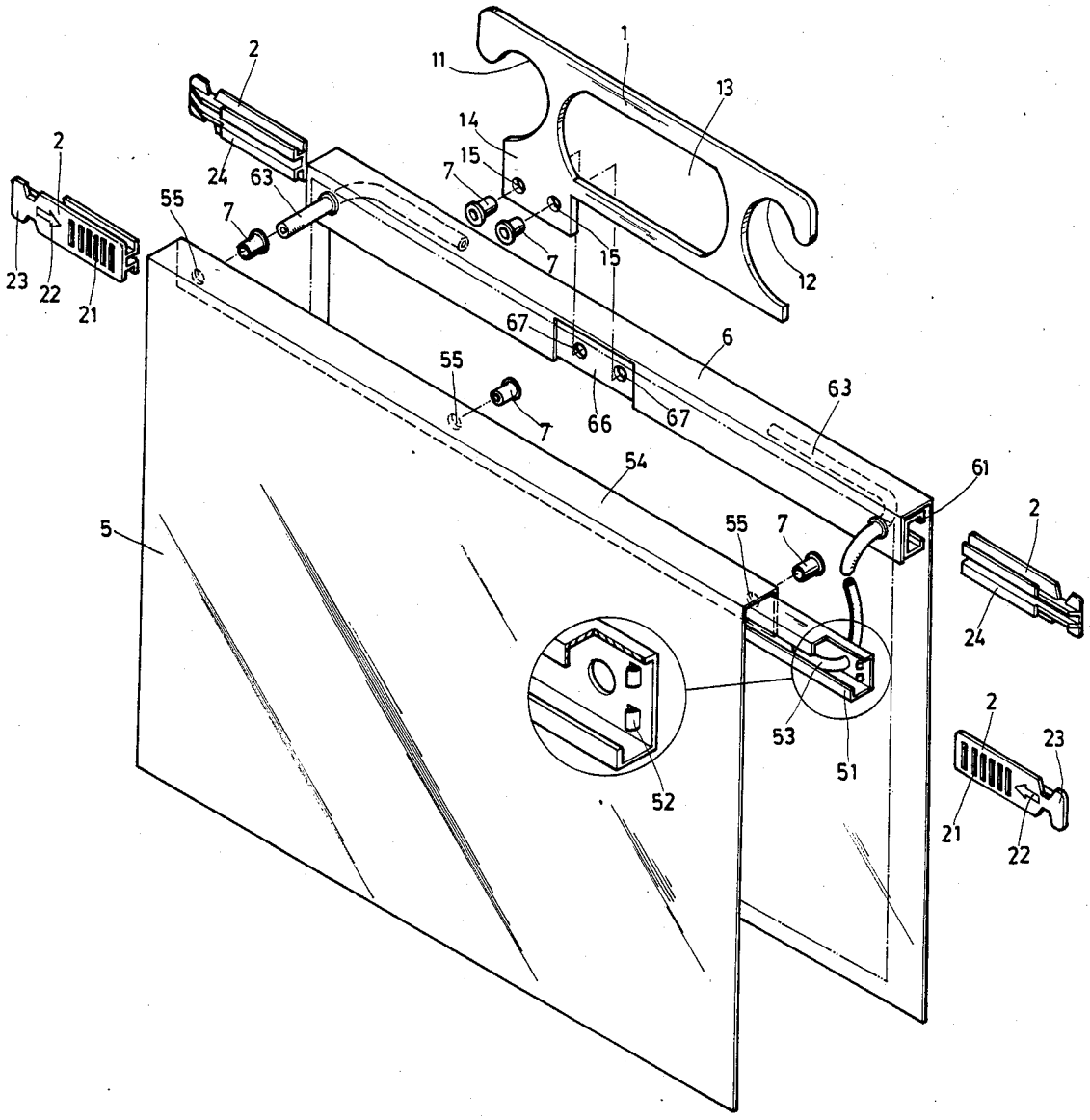
FIG. 1 is a perspective fragmentary view of the present invention.

Referring to FIGS. 1 through 4, a portable file for form feeds paper includes a hanger (1), four pieces of retainer means (2), a plurality of rivets (7), a plurality of flexible cords (53), an upper cover board (5) and a lower cover board (6).

The said hanger (1) comprises an oval slot (13) at the center, two circular notches (11) and (12) respectively arranged at both ends, and an extension (14) made at one side with one and more holes (15) made thereon.

The said four pieces of retainer means (2) are paired off and respectively arranged at both sides of the said upper and lower cover board (5) and (6), of which each retainer means comprises at the top surface a plurality of elongated grooves (21), an index (22) and a stopper (23), and comprises at the bottom surface a rail (24).

The said upper cover board (5) comprises at one side an channel bar (51) for setting therein of the said flexible cords (53), wherein said channel bar (51) includes thereinside one or more stop blocks (52) at both ends, of which the bending portion (54) comprises a plurality of holes (55) for setting therein of respective rivets (7) for further positioning of the said upper cover board (5). When a flexible cord (53) is set in the said channel bar (51) of the said upper cover board (5) respectively at each end, the respective retainer means (2) is set thereafter and stopped therein by the respective stop blocks (52) such that the rail (24) (in a shape of two lines parallel with each other) is bilaterally disposed in the channel bar (51) to retain the respective flexible cord (53) therebelow. When to set a file, the retainer means (2) is pushed to slide in the channel bar (51) by means of its bottom rail (24), and the upper cover board (5) is turned round along the being portion (54) of the channel bar (51) to let the bilateral flexible cords (53) be exposed. Both the bilateral two flexible cords (53) are further pulled straight for setting of tform feeds paper through the perforations of the form feeds paper. After setting of the form feeds paper, the two flexible cords (53) at both ends are turned to set in the channel of the channel bar (51) and the upper two retainer means (2) are respectively set in the channel bar (51) at both ends to let the two flexible cords (53) be retained respectively in the bottom rail (24) of each retainer means (2) such that the sliding of each retainer means (2) on the channel bar (51) is smoothly operated by means of pressing of finger on the elongated grooves (21) to push the respective retainer means (2) according to the direction of the index (22).

Figure 2:
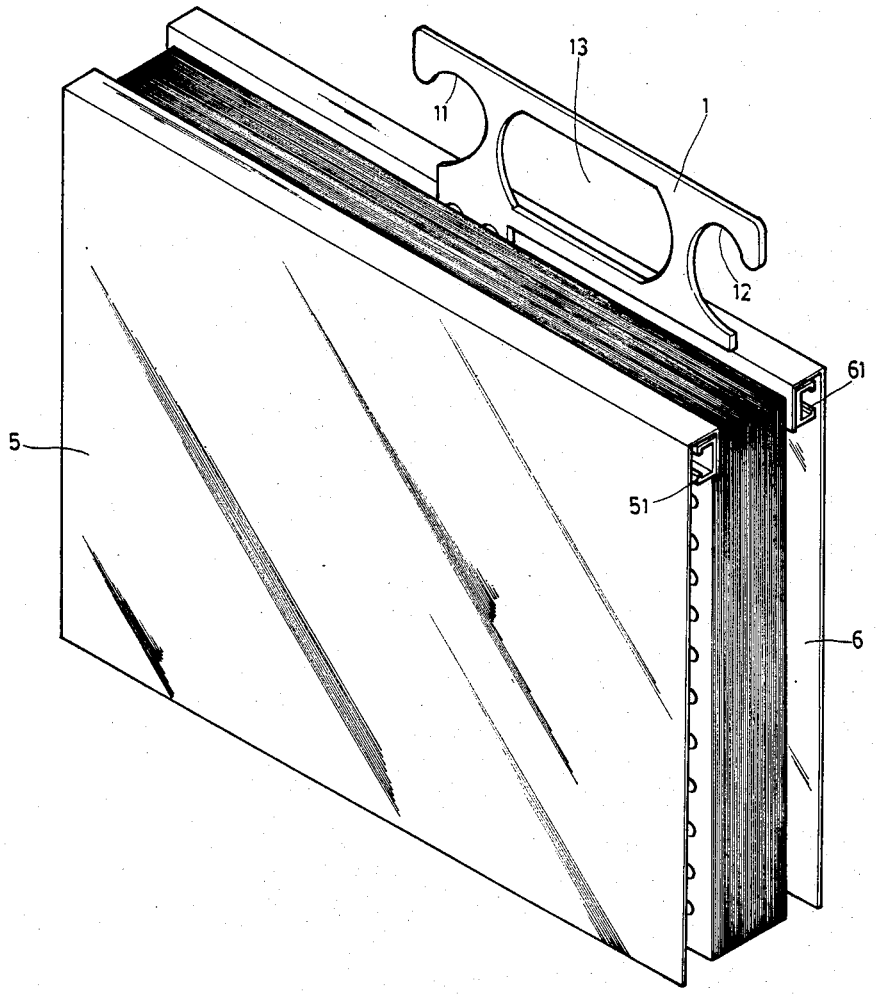
FIG. 2 is a perspective assembly view of the present invention.

According to the present invention, the lower cover board (6), similar to the upper cover board (5), comprising a channel bar (61) for setting therein of flexible cords (63) and retainer means (2). Therefore, during setting of form feeds paper document, it may be set in the file through either side. Further, the lower cover board (50 comprises a recess (66) at the center of the channel bar (61), having thereon one and more holes (67), such that the extension (14) of the hanger (1) is set in the recess (66) and fixedly attached thereto by means of rivets (7) to respectively insert into the holes (15) of the extension (14) and the holes (67) of the recess (66). By means of said arrangement, the hanger (1) and the lower cover board (6) are connected together as shown in FIG. 2.

In the present invention, the flecible cords (53) (63) are arranged to insert through the perforations of form feeds paper document and retained by the retainer means (2) in the channel bars (51) (61), wherein the retainer means (2) are allowed to slide along the channel bars (51) (61) by means of the bottom rail (24).

According to the present invention, the flexible cords (51) (61) which are arranged to insert through the perforations of form feeds paper are provided for holding form feeds paper up to 100 m/m thick (or 1200 pages approximately).

Figure 3:
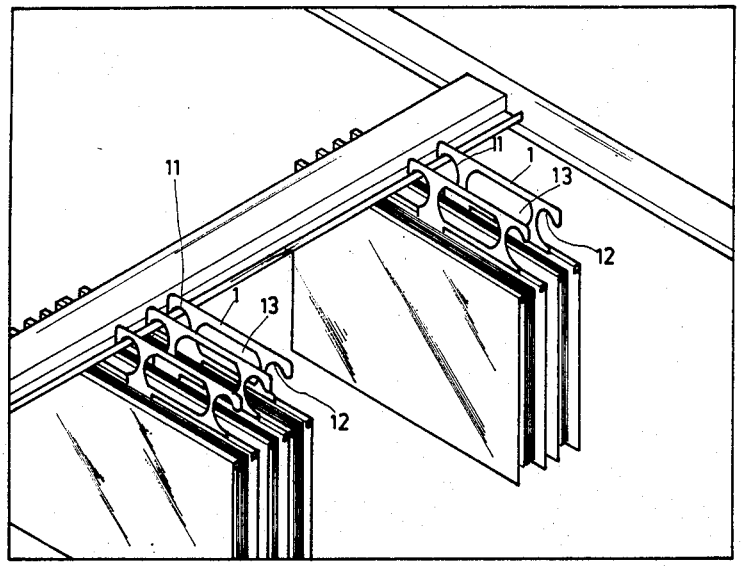
FIG. 3 is a schematic drawing of an embodiment of the present invention, illustrating that a file is hanging on a storage stand by means of a hanger.
Figure 4:
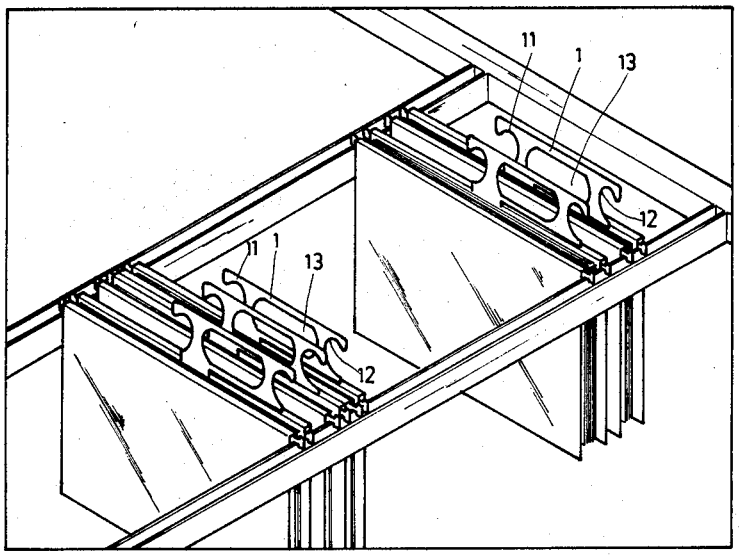
FIG. 4 is a schematic drawing of another embodiment of the present invention, illustrating that a file is hanging on a storage rail stand by means of the bilateral hook means of the file.

In the present embodiment, the hanger (1) comprises an oval slot (13) at the center for holding of hand to conveniently carry the file, and also comprises two circular notches (11) and (12) at both ends for hanging of the file on a frame stand by means of either notch (11) or (12) as shown in FIG. 3. According to the present invention, the upper cover board (5) and the lower cover board (6) may be respectively arranged to provide a hook means at both ends for hanging of the file on the rail of a storage frame stand to suspend the form feeds document as shown in FIG. 4.

I claim:

1. A portable file for form feeds paper including a hanger, a plurality of retainer means, a plurality of rivets, an upper cover board and a lower cover board; said hanger comprising an oval slot made at the certer for holding of hand to carry the file, two circular notches respectively arranged at both ends for hanging of the file on a frame stand, and an extension made at one side with one and more holes made thereon, said hanger being set in a recess made at the center of said lower cover board to let said hanger be connected with said lower cover board by means of rivets through the holes of said extension of said hanger and the holes made on said recess; said upper and lower cover boards each comprising a [—]-shaped channel bar at one side for setting therein a flexible cord respectively at both ends, said flexible cord being turned straight for insertion into the perforations of form feeds paper document, said retainer means being respectively set in said channel bars of said upper and lower cover boards at both ends, said retainer means comprising at the top surface a plurality of elongated grooves, an index and a stopper, and also comprising at the bottom surface a rail; by means of pressing on said elongated grooves of said retainer means, each said retainer means being pushed to slide in said channel bar of said upper or lower cover boardby means of said rail of each retainer means along the direction of said index, so as to let each said flexible cord be further pulled straight for setting of form feeds paper through the perforations of the form feeds paper, and each said retainer means being pushed back to the both ends of said elongated channel of each upper and lower cover board to retain said flexible cords respectively, said retainer means being stopped by stop blocks made on both ends of said channel bars to prevent from breaking of said retainer means from said channel bars of said upper and lower cover boards so as to let form feeds paper document be firmly retained in the file.

2. A portable file for form feeds paper according to claim 1, wherein said hanger comprising two circular notches at both ends for hanging of the file on a frame stand by means of either notch; said upper and lower cover boards being respectively arranged to provide a hook means at both ends for hanging of the file on the rail of a storage frame stand to suspend the form feeds paper document.

* * * * *